US005186581A

United States Patent [19]

Ngoc et al.

[11] Patent Number: 5,186,581

[45] Date of Patent: * Feb. 16, 1993

[54] GRAVITY BASE STRUCTURE OF AN OFFSHORE PLATFORM RESISTING TO ICEBERGS

[75] Inventors: Guy P. Ngoc, Neuilly-Plaisance; Tuong L. Huynh, Louvres, both of France

[73] Assignee: Doris Engineering, Paris, France

[ * ] Notice: The portion of the term of this patent subsequent to Mar. 6, 2007 has been disclaimed.

[21] Appl. No.: 629,697

[22] Filed: Dec. 18, 1990

[30] Foreign Application Priority Data

Jan. 30, 1990 [FR] France ..... 90 01055

[51] Int. Cl.[5] ..... E02D 19/04; E02D 27/52

[52] U.S. Cl. ..... 405/217; 405/211; 405/210; 405/203

[58] Field of Search ..... 405/217, 211, 210, 203, 405/204

[56] References Cited

U.S. PATENT DOCUMENTS 3,708,987 1/1973 Roulet et al. ..... 405/210
4,422,804 12/1983 Gerwick, Jr. .
4,470,725 9/1984 Kure et al. ..... 405/217 X
4,478,537 10/1984 Birdy .
4,504,172 3/1985 Clinton .
4,906,138 3/1990 Barbaras et al. ..... 405/217 X
5,044,830 9/1991 Barbaras et al. .

FOREIGN PATENT DOCUMENTS 2615217 11/1988 France .

*Primary Examiner*—Randolph A. Reese
*Assistant Examiner*—J. Russell McBee
*Attorney, Agent, or Firm*—Stevens, Davis, Miller & Mosher

[57] ABSTRACT

The structure comprises a concrete monolithic caisson (3) consisting of a top slab (5) and a bottom slab (5') resting on a seabed. Two concentric peripheral walls (6, 7), an inner and an outer respectively, are designed to withstand the impacts of icebergs. These two walls (6, 7) extend substantially vertically between the slabs (5, 5') and are rigidly connected with them. Vertical partitions are arranged between the two walls so as to connect them in a lattice structure. Vertical defensive elements (8, 9) are disposed over at least a part of the outer periphery of the caisson. The defensive elements (8, 9) are integral with the outer wall of the caisson (3). These caissons are intended for a platform structure located in Arctic regions for production in a hydrocarbon field.

7 Claims, 2 Drawing Sheets

GRAVITY BASE STRUCTURE OF AN OFFSHORE PLATFORM RESISTING TO ICEBERGS

BACKGROUND OF THE INVENTION

The present invention relates to a gravity base structure for an offshore platform and, more particularly, to a structure of this type designed to be erected in waters infested with icebergs and to withstand subsequent collision with the latter.

Barbaras et al U.S. Pat. No. 4,906,136 filed by the present assignee, discloses a platform structure of this type which comprises a concrete monolith caisson supported by a bottom slab resting on the seabed, this caisson having a configuration of vertical teeth which form defensive elements capable of withstanding the impacts of icebergs and of absorbing the energy transmitted. The caisson also comprising a top slab directly or indirectly supporting the deck of the platform and, between the two slabs, a peripheral double wall which is formed by two concentric walls interconnected by vertical partitions which form a lattice structure of triangular prisms, the outer concentric wall carrying the defensive elements.

The defensive elements having the shape of teeth break up the surface of the iceberg when it impacts, and dissipate the energy of the impact and transmit the forces resulting from the impact to the structural elements of the peripheral double wall.

A platform of this type well withstands iceberg impacts. However, economic considerations have induced a critical study of this platform with the aim of reducing its construction cost while at the same time preserving, or even improving, the resistance of the platform to the impact of icebergs.

In this respect, it has been noted that the defensive elements of the platform of the above mentioned patent consist of reinforced concrete walls presenting a larger outer surface area with an important quantity of concrete and reinforcements. With reference to FIGS. 2 and 4 of the abovementioned patent, it furthermore appears that the use of defensive elements attached to the external face of the outer wall of the caisson implies a presence of partitions of the double wall leading to six-branched "nodes" which are difficult, and therefore expansive, to produce.

It will also be noted that the defensive elements with a triangular shape according to the embodiment in FIG. 4 of the above-mentioned patent are inclined quite steeply to the surface of the outer wall. Such an arrangement creates substantial tangential forces within the structure resulting from an oblique iceberg impact on the caisson. As a consequence, it is then necessary to reinforce the structure against such forces, which has a further unfavorable effect on its cost.

SUMMARY OF THE INVENTION

The object of the present invention is therefore to provide a gravity base structure for an offshore platform to be installed in waters infested with icebergs, which is designed so as to reduce its construction cost, when comparing to the structure of the abovementioned patent.

Another object of the present invention is to provide such a platform of simplified design and construction which leads to additional reduction of cost of labor and materials.

A further object of the present invention is to design such a platform which is subject to lower tangential forces with the structure upon oblique impact of an iceberg striking the platform.

These objects of the invention, as well as others which will be presented through the present description, are achieved with a gravity base structure for an offshore platform which resists to the impacts of icebergs. The structure comprises a concrete monolithic caisson consisting of a top slab, a bottom slab resting on a seabed, two concentric peripheral walls, an inner and an outer respectively, designed to withstand the impacts of icebergs. These two walls extend substantially vertically between these slabs and rigidly connected with them, are vertical partitions arranged between the two peripheral walls so as to connect them in a lattice structure, and substantially vertical defensive elements which are disposed over at least a part of the periphery of the caisson. According to the present invention, the defensive elements are integral with the outer wall of the caisson.

Each defensive element consists of two plane vertical walls which form part of the outer wall and define a dihedron which is symmetrical about the diameter of the caisson passing through the ridge of the dihedron.

According to another feature of the platform of the invention, each defensive element is connected to the inner wall by a unit composed of two partitions having, in horizontal cross-section, and "X" shape, each of those partitions extending between the inner wall and about a midpoint of an inner planar surface of a plane wall which is part of the defensive element.

According to another feature of the structure according to the invention, two consecutive "X"-shaped units of partitions are separated by a "V"-shaped unit of partitions, each partition of this latter unit extending from an intersection of the inner wall with a partition of the adjacent "X"-shaped unit, to the intersection of two adjacent defensive elements.

According to yet another advantageous feature of the structure according to the invention, the angular opening of the dihedron defined by the walls of the defensive element is between 100° and 130 °, in order to reduce the tangential forces applied to the platform in the event of an oblique impact with an iceberg.

BRIEF DESCRIPTION OF THE DRAWINGS

Other features and advantages of the present invention will become evident upon reading the description below and examining the attached drawing, in which.

DETAILED DESCRIPTION OF A PREFERRED EMBODIMENT

Figure 1:
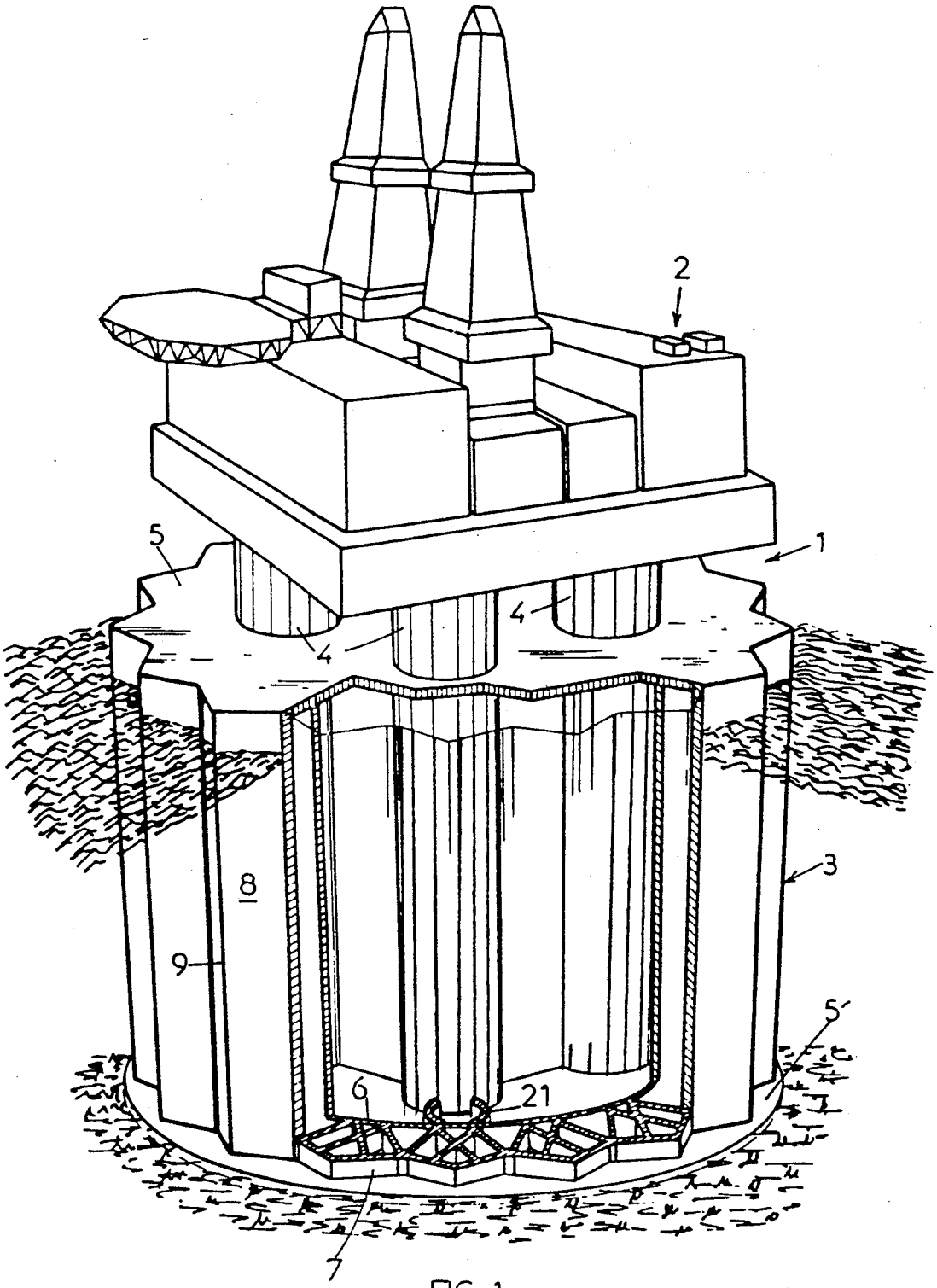
FIG. 1 is a perspective view, partly broken-away of a platform structure according to the invention.

FIG. 1 shows an oil production platform structure 1 of the type described in the abovementioned Barbaras U.S. Pat. No. 4,906,138 modified according to the present invention, as will be seen below in detail.

The structure rests on the seabed and supports a deck 2 upon the technical installations and accommodation modules are arranged. Since the platform is intended to be used in cold regions, the Arctic for example, the installations are sheltered and air-conditioned.

The structure consists of a caisson 3 having a bottom from which one or more compartments rise in the form of columns 4 supporting the deck 2, above a top slab 5 which closes the upper part of the caisson.

The caisson 3 is a monolithic structure generally cylindrical in shape. It has a bottom slab 5' resting on the seabed and upon which there rises, in an area close to its periphery, a double wall formed by two concentric walls 6, 7, an inner and an outer respectively, and rigidly connected to the top slab.

Figure 2:
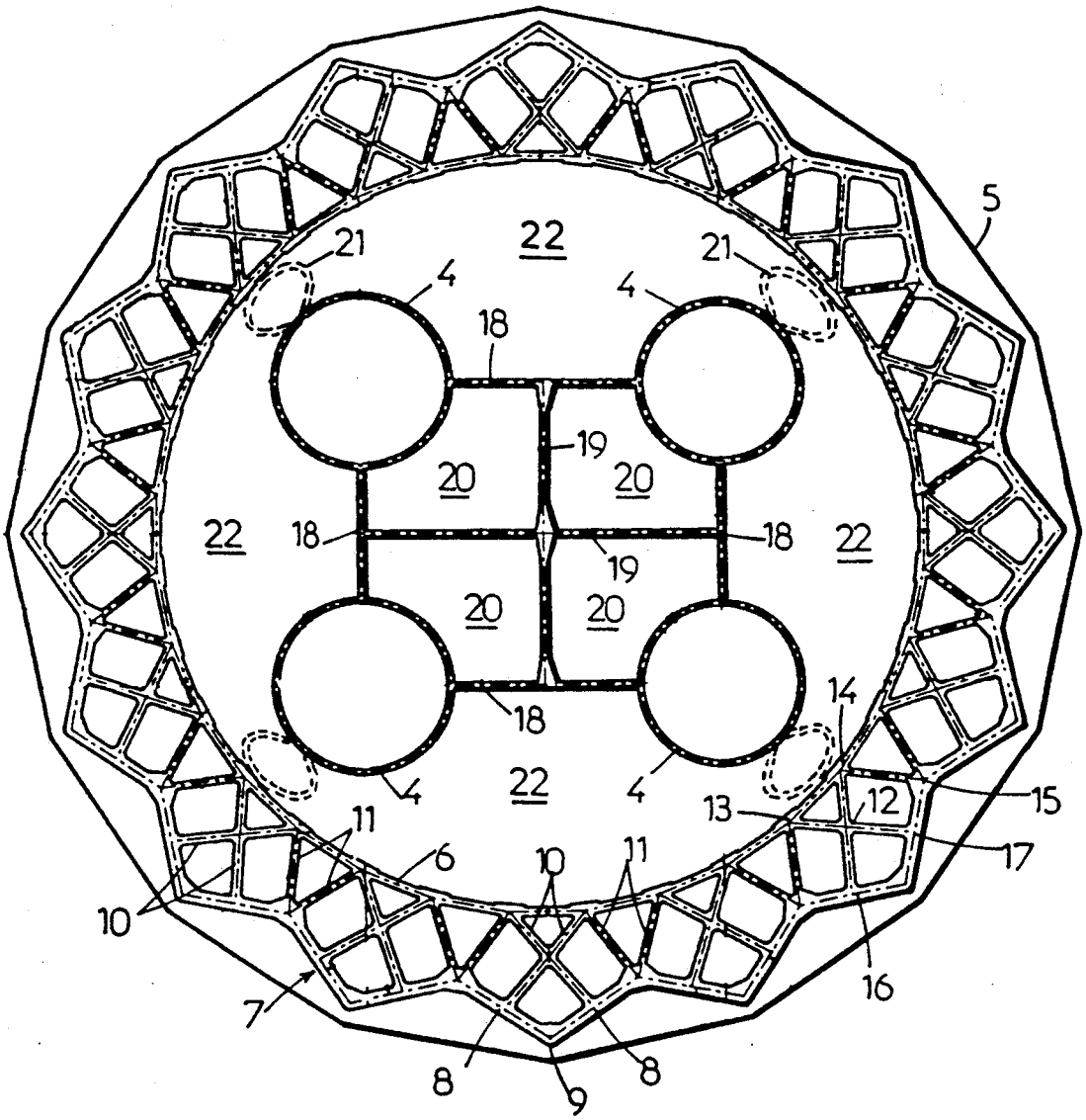
FIG. 2 is a plan sectional view of the caisson of the platform in FIG. 1.

An advantageous feature of the structure according to the invention, which can be seen in the cross-sectional view in FIG. 2, is that the outer wall 7 of the caisson 3 is composed of defensive elements (8, 9), capable of breaking up the surface of an iceberg which strikes the caisson 3. According to the invention, the wall 7 thus takes the form of a regular series of pairs of vertical walls 8 joined together continuously, the walls of each pair being inclined to each other symmetrically about the plane passing through a diameter of the platform so as to form a "tooth" or a defensive element with an outside ridge 9 capable of breaking up an iceberg striking this ridge. The outer wall 7 shaped in this way is connected to the inner wall 6 by partitions which will be described further hereinbelow.

If the double wall 6, 7 of the caisson 3 of the platform according to the invention is now compared with the double wall of the platform described in the abovementioned patent application, it is evident that it is distinguished essentially be the integration of the teeth 8, 9 into the outer wall 7. Studies have been able to put the saving in concrete and reinforcements resulting from the integration of the defensive elements into the outer wall at 10%. This material saving provides, of course, further reduction in the deployment of the said material, and therefore in labor.

As it is known from the art, in addition to the steel reinforcements required for the structure and mentioned herein-above, prestressing cables may be install in certain elements of the caisson 3.

The outer wall 7 shaped in this way according to the invention is connected to the inner wall by the bottom slab 5' and the top slab 5. Moreover, vertical partitions connecting the two walls, in order to strengthen the resistance of the double wall to the impacts of icebergs, extend from the slab 5' to the slab 5. In sectional view (see FIG. 2), the lattice takes the form of a repeating pattern of pairs of partitions 10 forming an "X"-shaped unit, another pair 11 of partitions forming a "V"-shaped unit in between two consecutive "X"-shaped units.

Each partition 10 of an "X"-shaped unit extends from the inner wall 6 to about the middle of a plane wall 8 being part of a defensive element.

Each partition 11 of a "V"-shaped cell extends from an intersection 13, 14 of the inner wall 6 and of a partition 10 of an adjacent "X"-shaped unit to the intersection 15 of two adjacent defensive elements.

It will be noted that this arrangement of partitions has nodes with four branches 12, 13, 14, 15 or nodes with three branches 16, 17 but no six-branched nodes, as distinct from the arrangement of partitions of the structure described in the abovementioned Barbaras et al patent. The invention simplifies considerably the construction of the double wall of the structure according to the invention, due to the reduction in the number of layers of reinforcements which intersect.

It will also be noted that the arrangement of the partitions, connecting the two walls, in "X"- and "V"-shaped units, ensures a better distribution of the forces caused by the icebergs, the transmission of these forces being effected through more structural elements than in the arrangement described in the abovementioned patent. This improved distribution enables more partitions to be involved in the transmission of the impacts and therefore the stresses to which each of them is subjected are reduced. As a result the thickness of each partition may be reduced.

It will further be noted, in FIG. 2, that the dihedrons defined by the defensive elements (8,9) of the platform structure according to the invention are more open, towards the inside of the platform, than the corresponding dihedrons defined by the triangular defensive elements 15 shown in the FIG. 4 of the abovementioned patent. According to the invention, the opening of these dihedrons is increased so that it is of the order of 100° to 130°, preferably about 110°. This arrangement provides a satisfactory compromise between the opening required to ensure a satisfactory breaking up of an iceberg upon impact and that which reduces the tangential forces applied to the platform upon oblique impact with such an iceberg.

As shown in FIG. 2, gussets may reinforce the nodes 12, 13, 14, 15, 16 and 17 formed at the intersections of the partitions.

In FIG. 2, it is further shown that, in a conventional manner, the internal walls 18 and 19 define compartments 20 between the support columns 4 of the deck 2. These compartments are used for storing fluids, for example the crude oil extracted by the platform.

The invention is, of course, not limited to the embodiment described or shown which has been given merely by way of example. Hollow cylindrical volumes 21 (shown in broken lines in FIG. 2) could be placed between the inner wall 6 and the columns 4, or other internal walls may be arranged inside the caisson, in order to establish other storage compartments 22. These volumes have a horizontal cross-section which is generally curved so as to provide flexibility towards forces generated on the peripheral double wall by the impacts of icebergs and to prevent the transmission of these forces to the walls of inner compartments, which these forces could damage.

Similarly, the invention is not limited to a platform structure having defensive elements with a triangular cross-section. These defensive elements could take other forms, such as those of rounded teeth, as shown in FIG. 2 of the abovementioned U.S. Pat. No. 4,906,138.

We claim:

1. A gravity base structure for offshore platforms for resisting the impact of icebergs, said structure comprising:

a concrete monolith caisson having a bottom slab for resting on the seabed and top slab for support of equipment;

an inner wall extending substantially vertically between said top and bottom slabs;

an outer wall generally concentric with said inner wall so as to define an annular area between said inner and outer walls and extending substantially vertically between said top and bottom slabs;

said outer wall consisting of a plurality of interconnected dihedron shaped defensive elements each of which is formed by two vertical walls connected an an angle to each other and which disposed over at least a part of the periphery of the caisson, each of said vertical walls having an inner planar surface and a midpoint;

a plurality of vertical partitions totally within said annular area between said inner and outer walls to define a lattice structure within said annular area, at least some of said partitions being directly connected to said inner planar surfaces of said vertical walls approximately at said midpoints.

2. The structure of claim 1 in which said inner wall is substantially circular in cross section.

3. Structure according to claim 2 in which each dihedron is symmetrical about a diameter of the caisson, said diameter passing through a ridge of said dihedron.

4. Structure according to claim 3 in which each defensive element is connected to the inner wall by two partitions defining, in plan sectional view, an "X"-shaped unit, each partition extending between the inner wall and about a middle of the plane wall being a part of a defensive element.

5. Structure according to claim 4 in which two consecutive "X"-shaped units are separated by a "V"-shaped unit of partitions, each partition of the "V"-shaped extending from an intersection of the inner wall and of a partition of an adjacent "X"-shaped unit, to the intersection of two adjacent defensive elements.

6. Structure according to claim 3 in which an opening of a dihedron defined by the walls of the defensive element is between 100° and 130°, in order to reduce tangential forces applied to the platform in the even of oblique impact of an iceberg.

7. Structure according to claim 1 in which elements of the concrete monolith caisson are reinforced by steel reinforcements and prestressing cables.

* * * * *

UNITED STATES PATENT AND TRADEMARK OFFICE

CERTIFICATE OF CORRECTION

PATENT NO. : 5,186,581

DATED : February 16, 1993

INVENTOR(S) : Guy Ngoc PHAM et al

It is certified that error appears in the above-indentified patent and that said Letters Patent is hereby corrected as shown below:

On the title page, Item [19]: "Ngoc" should be "Pham" and Item [75]: Inventor "Guy P. Ngoc" should be "Guy N. Pham"

Column 4, line 65, (Claim 1) after "which disposed" should read --which are disposed--.

Signed and Sealed this

Twenty-ninth Day of March, 1994

*Attest:*

*Attesting Officer*

Bruce Lehman

BRUCE LEHMAN

*Commissioner of Patents and Trademarks*